US008316620B2

(12) United States Patent
Cotlet et al.

(10) Patent No.: US 8,316,620 B2
(45) Date of Patent: Nov. 27, 2012

(54) INTERLOCKING DOOR ASSEMBLY AND METHOD OF MANUFACTURING THEREOF

(75) Inventors: Mihai Cotlet, Dover, OH (US); Christopher Nolt, Dalton, OH (US); Chad Badger, Fredericksburg, OH (US)

(73) Assignee: Provia Door, Inc., Sugarcreek, OH (US)

( * ) Notice: Subject to any disclaimer, the term of this patent is extended or adjusted under 35 U.S.C. 154(b) by 703 days.

(21) Appl. No.: 12/168,452

(22) Filed: Jul. 7, 2008

(65) Prior Publication Data

US 2010/0000157 A1 Jan. 7, 2010

(51) Int. Cl.
*E04C 2/54* (2006.01)

(52) U.S. Cl. ..... 52/784.13; 52/784.1

(58) Field of Classification Search ..... 52/503, 52/784.1, 784.13; 29/897.3; 403/329
See application file for complete search history.

(56) References Cited

U.S. PATENT DOCUMENTS

| | | | | |
|---|---|---|---|---|
| 2,853,162 | A * | 9/1958 | David et al. | 49/382 |
| 3,252,262 | A * | 5/1966 | Jessen | 52/784.14 |
| 3,263,368 | A * | 8/1966 | Hildum et al. | 49/382 |
| 4,193,245 | A * | 3/1980 | Johnson | 52/656.4 |
| 5,154,019 | A * | 10/1992 | Day | 49/504 |
| 5,392,565 | A * | 2/1995 | Rentschler | 49/504 |
| 6,311,454 | B1 * | 11/2001 | Kempel | 52/784.15 |
| 7,451,575 | B2 * | 11/2008 | Hall et al. | 52/289 |
| 2004/0040959 | A1 * | 3/2004 | Menceles | 220/23.2 |

* cited by examiner

*Primary Examiner* — Jeanette E Chapman
*Assistant Examiner* — Daniel Kenny
(74) *Attorney, Agent, or Firm* — McDonald Hopkins LLC

(57) ABSTRACT

An interlocking door includes a first skin with at least one protrusion and at least one mounting slot and a second skin with at least one protrusion. An end cap is slidingly engaged with the first skin and secured with an adhesive. The first and second skins are secured to one another upon sliding engagement of the first skin at least one mounting slot and the second skin at least one protrusion. The skins are fixedly secured with an adhesive.

20 Claims, 14 Drawing Sheets

INTERLOCKING DOOR ASSEMBLY AND METHOD OF MANUFACTURING THEREOF

BACKGROUND OF THE INVENTION

1. Technical Field

The invention relates generally to interlocking door skins and a method of manufacturing a door. More particularly, the invention relates to door skins having a plurality of interlocking tabs which function to secure the door skins as a unit. Specifically, the invention relates to interlocking door skins which are secured to one another with a plurality of interlocking tabs and sealed together with glue in order to provide a heavy door which is easy to manufacture and will survive the rigors of industrial use.

2. Background Information

Doors in general, but industrial doors in particular, have suffered from a variety of defects which lead to dangerous operating conditions or unsatisfying build quality. Since wood is generally light and can be shaped and cut easily, wooden doors do not suffer from unsatisfying build quality. Nevertheless, wooden doors cannot withstand the harsh environments required of industrial applications and are therefore inappropriate.

Steel or metal doors, on the other hand, provide strength and the ability to withstand extreme environmental conditions. Due to the heavy material, the metal doors generally have a hollow cavity in order to substantially reduce the overall weight.

Traditionally, the metal door was manufactured with two door skins if the top and bottom pieces were manufactured integral to the respective door skins or four pieces if the top and bottom pieces were not integral to one of the door skins. One traditional method of manufacturing the door is to weld the pieces together at the seams. The welded door provides great resistance to the harsh environment and can generally withstand fires, but suffers from being a time consuming and costly procedure as well as unattractive.

The welded door is unattractive due to the welded seams which contain a variety of bumps and ridges from the welding process. Further, the welding process is generally unreliable and may cause material flexing and fitment issues due to the extreme heat required to weld the door together. Finally, the welded door is costly to produce because an acceptable door must be prepped for welding and then welded. Not only is welding expensive and time consuming, the unattractive seams that result must be sanded and polished to provide an acceptable finish. The sanding and polishing procedures are objectionable because they are both labor intensive and messy.

A second method of manufacturing a metal door is to use an adhesive. While the adhesive is easier, cheaper, and faster than welding, the adhesive is unable to endure the high heat of a fire and will melt, thereby posing a safety hazard. The process of adhering the doors skins with an adhesive still takes more time than is desired because the skins cannot be glued and then moved to the next processing station, but instead must remain untouched until the adhesive hardens. Further, if the doors are moved before the adhesive hardens, then the door skins will not be properly aligned and the door may have to be scraped, thereby increasing production costs. Thus there is a demonstrated need for an interlocking door assembly which is capable of being produced quickly and efficiently without welding and is able to withstand harsh environments as well as the extreme heat of a fire.

SUMMARY OF THE INVENTION

The door of the present invention comprises a first skin having a first mechanical connection means extending from a first wall and a second mechanical connection means, a second skin having a third mechanical connection means, an end cap having a fourth mechanical connection means, wherein the end cap is secured to the first skin upon sliding engagement of the first mechanical connection means and the fourth mechanical connection means; and wherein the second skin is secured to the first skin upon engagement of the second mechanical connection means and the third mechanical connection means. The engagement of the first mechanical connection means and the fourth mechanical connection means prevents removal of the end cap. The first skin further comprises a stop preventing movement of the end cap beyond the stop. The first mechanical connection means may be at least one locking tab, the second mechanical connection means may be at least one mounting slot, the third mechanical connection means may be at least one protrusion, and the fourth mechanical connection means may be at least one slot. The first mechanical connection means may be at least one slot, the second mechanical connection means may be at least one protrusion, the third mechanical connection means may be at least one mounting slot, and the fourth mechanical connection means may be at least one locking tab. The at least one mounting slot includes a positioning portion and a locking portion wherein the second skin is releasably secured to the first skin upon sliding engagement of the at least one protrusion form the positioning portion to the locking portion. The at least one mounting slot may be a plurality of mounting slots disposed about a periphery of the first skin. The end cap of the present invention includes a plurality of bosses and may be fixedly secured to the first skin with an adhesive and the second skin is fixedly secured to the first skin with an adhesive. The first skin includes at least one locating tab wherein the end cap is releasably secured within the locating tab.

The first skin further includes a second wall generally parallel to and adapted to be spaced away form the first wall by a side wall, wherein the side wall includes at is least one axial protrusion, a plurality of sliding locks, and at least one mounting hole. The present invention may further include at least one hinge reinforcement plate having at least one mounting slot, a plurality of locking slots, and at least one securing hole wherein the at least one hinge reinforcement plate is fixedly secured to the side wall upon sliding engagement of the at least one axial protrusion and the at least one mounting slot. The hinge reinforcement plate may be fixedly secured to the side wall upon sliding engagement of the plurality of sliding locks and the plurality of locking slots.

The method of manufacturing a door of the present invention comprises stamping a first skin with at least one locking tab and at least one mounting slot, stamping a second skin with at least one protrusion, stamping an end cap with at least one slot, applying a first layer of adhesive within the first skin, inserting the end cap within the first skin and in contact with the first adhesive, applying a second layer of adhesive on a top side of the end cap and the first skin, and disposing the second skin at least one protrusion within the at least one mounting slot and in contact with the second layer of adhesive. Alternatively, adhesive may be applied to the second skin directly. The method also includes stamping a side wall in the first skin, stamping at least one axial protrusion, a plurality of sliding locks, and at least one mounting hole in the side wall, and disposing a hinge reinforcement plate on the at least one axial protrusion and the plurality of sliding locks. The method further includes stamping a positioning portion and a locking portion in the at least one mounting slot and urging the second skin at least one protrusion within the at least one mounting slot from the positioning portion to the locking portion.

BRIEF DESCRIPTION OF THE DRAWINGS

The preferred embodiments of the invention, illustrative of the best modes in which Applicant has contemplated applying the principles of the invention, are set forth in the following description and are shown in the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
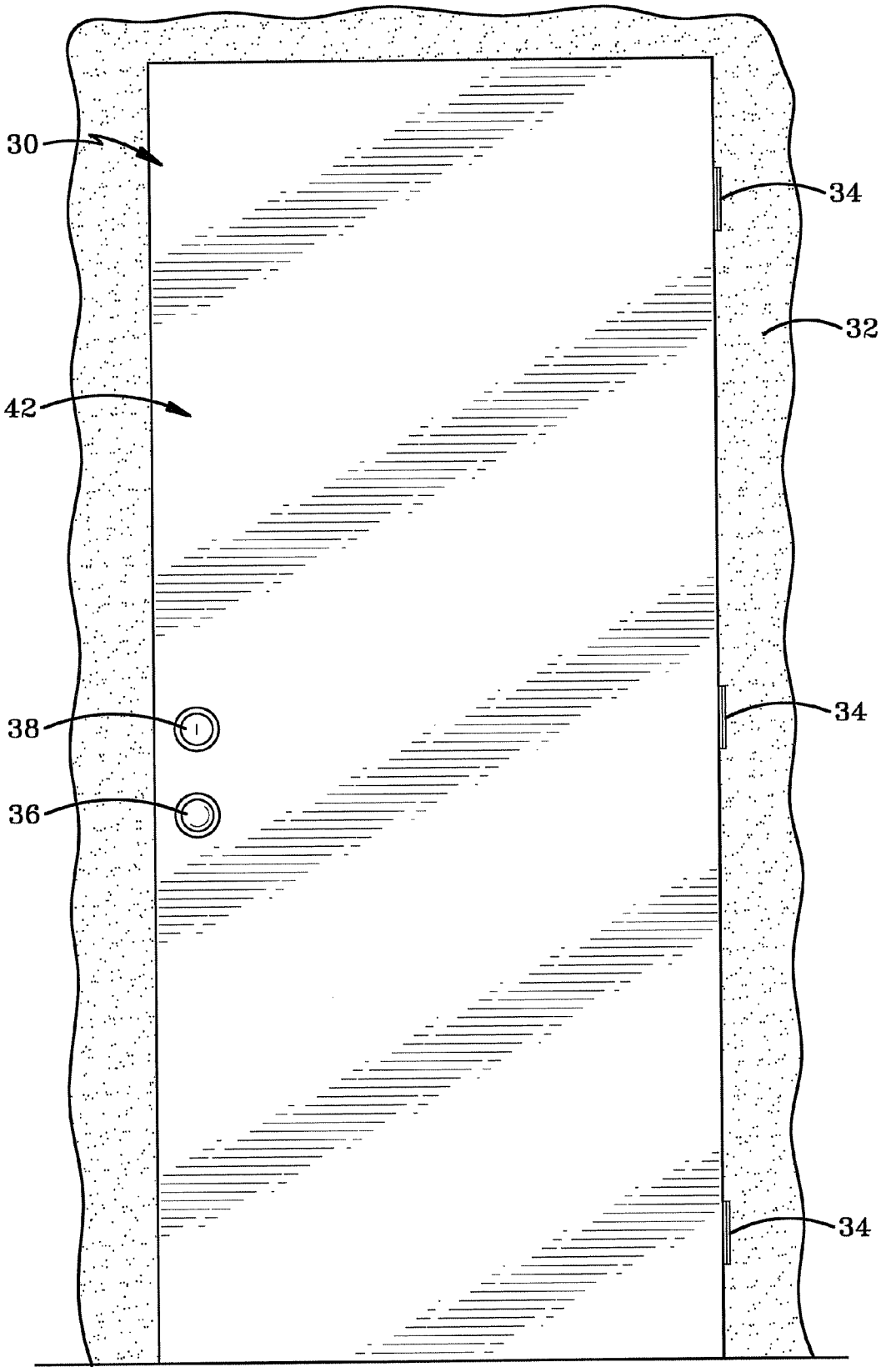
FIG. 1 is a front view of a preferred embodiment interlocking door assembly with hinges.
Figure 2:
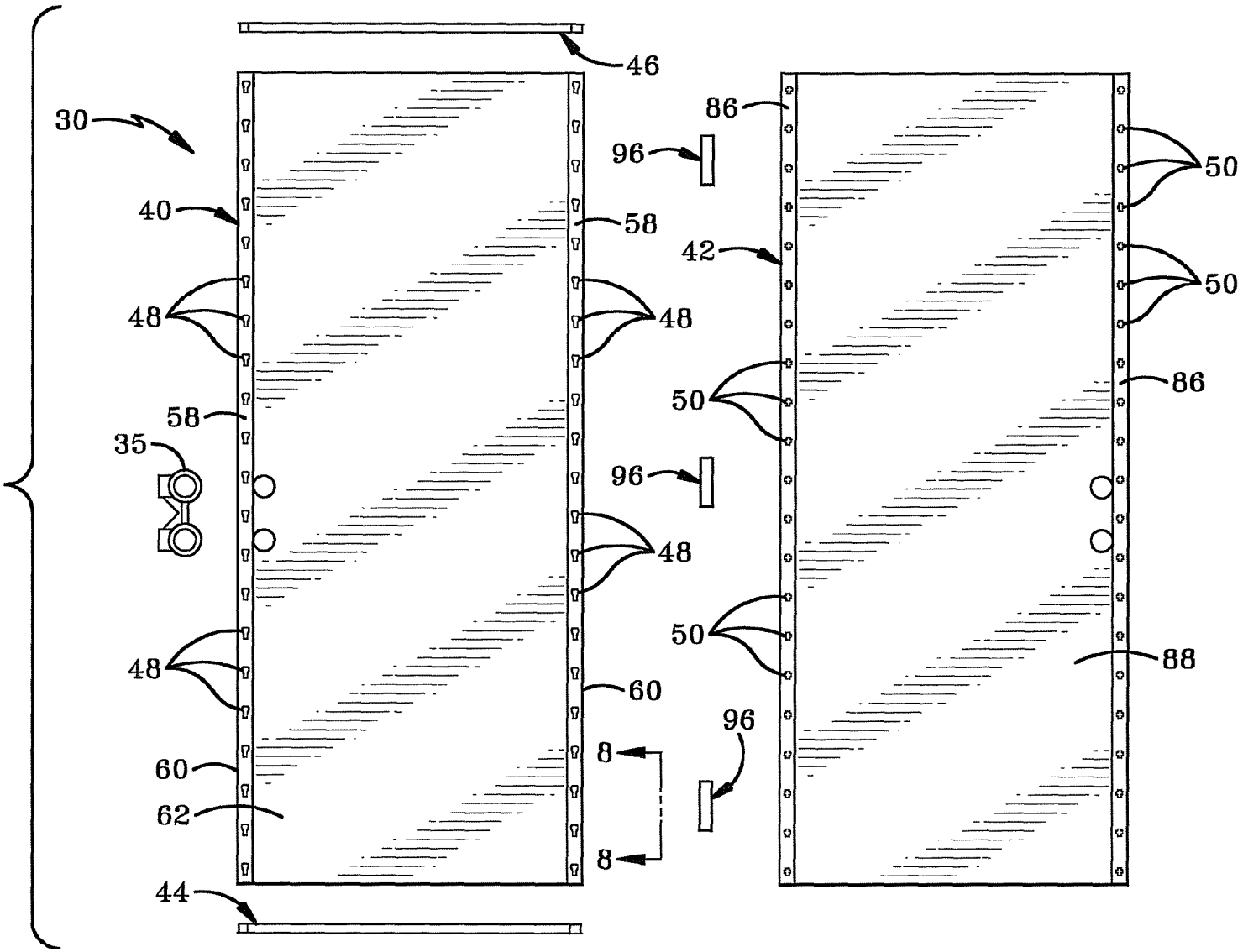
FIG. 2 is an exploded view of a preferred embodiment interlocking door assembly.

The interlocking door of the present invention is indicated generally at door assembly 30, as is particularly shown in FIGS. 1 and 2. Door assembly 30 is mounted to wall 32 with hinges 34. Similar to a traditional door, door assembly 30 may include housing 35 for mounting door handle 36 and deadbolt 38.

In accordance with one of the main features of the invention, door assembly 30 generally includes base skin 40, top skin 42, lower end cap 44, and upper end cap 46. Base skin 40 includes mounting slots 48 and top skin 42 includes protrusions 50.

Figure 3:
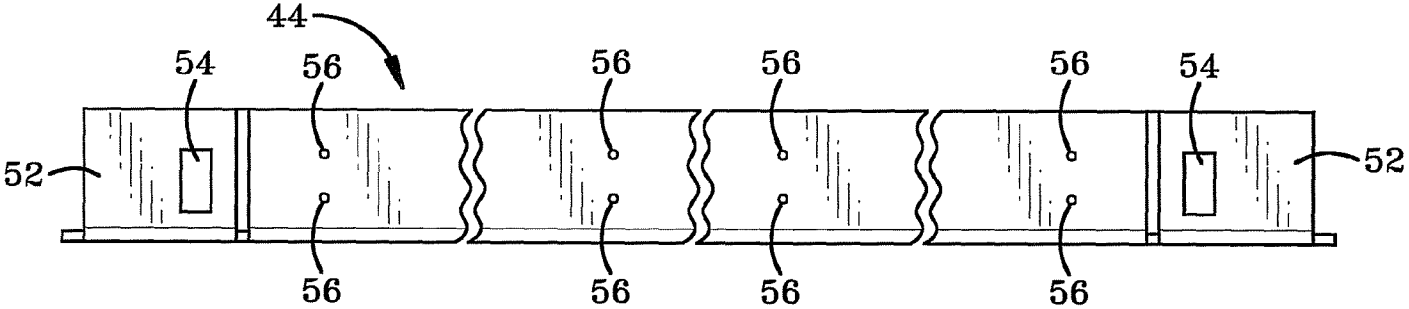
FIG. 3 is a top view of a preferred embodiment end rail with bosses and mounting slots.
Figure 4:
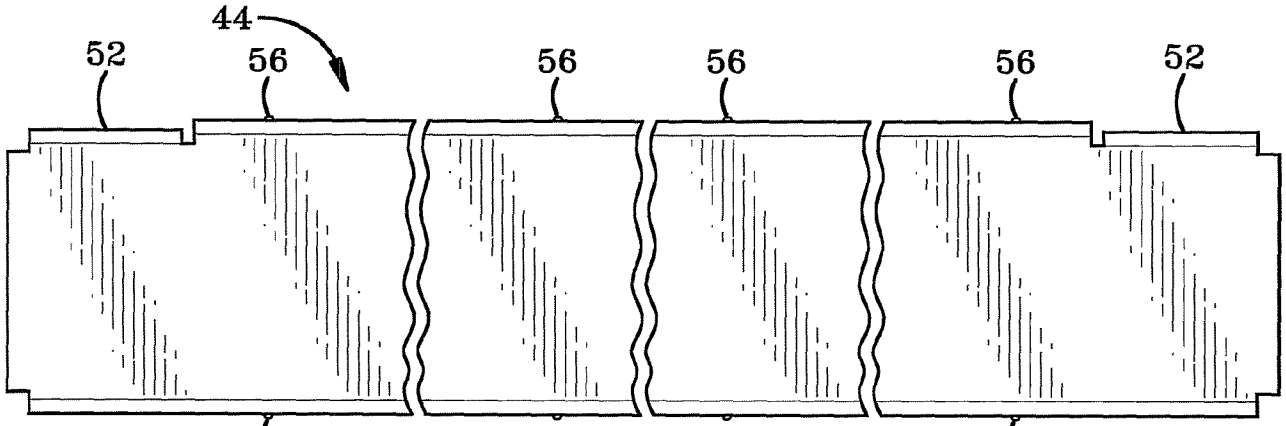
FIG. 4 is a side view of a preferred embodiment end rail with bosses.
Figure 5:
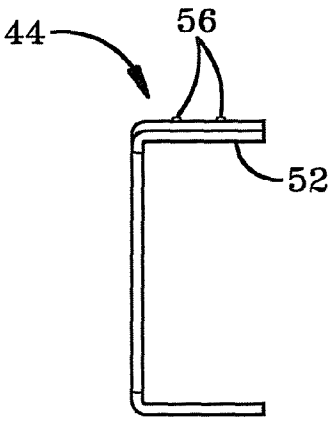
FIG. 5 is an endwise side view of a preferred embodiment end rail with bosses.
Figure 6:
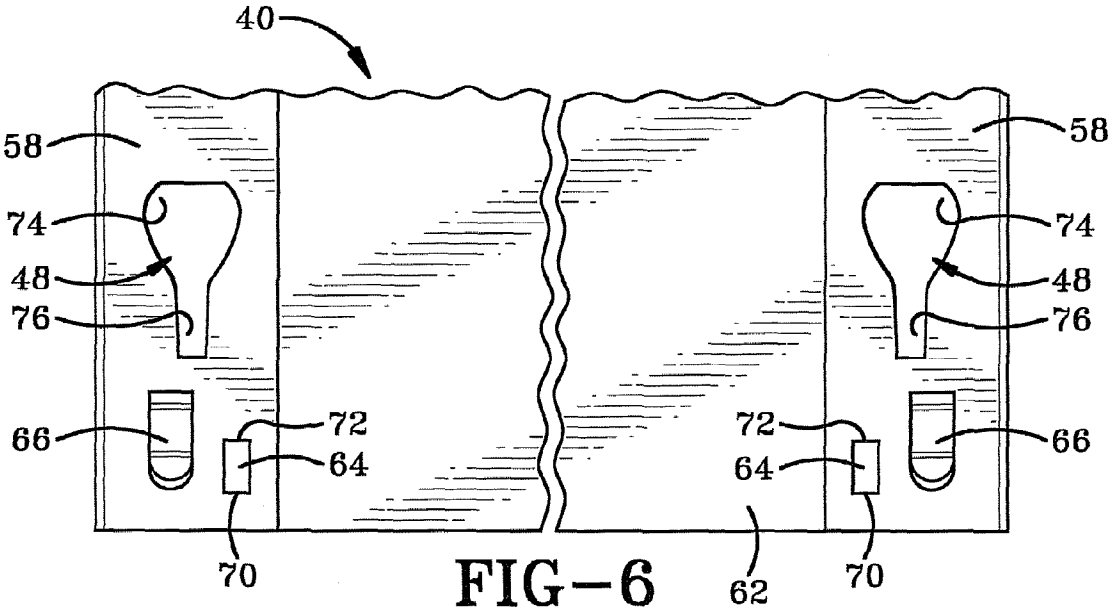
FIG. 6 is an enlarged front view of a preferred embodiment base skin with mounting slots.

Averting now to FIGS. 3, 4, and 6, lower end cap 44 preferably includes fastening ends 52 with slots 54. The lower end cap includes bosses 56 located between fastening ends 52 on both the top and bottom sides of the end cap to provide a gap for an adhesive. Advantageously, fastening ends 52 are slightly smaller than the endwise opening of the base skin (described infra) to allow the fastening ends to fit securely within the base skin endwise opening. The lower end cap may be composed of steel, stainless steel, aluminum, polycarbonate, or any other suitable plastic or metal composition. The foregoing description of lower end cap 44 is applicable to upper end cap 46 which is both structurally and functionally similar.

Figure 8:
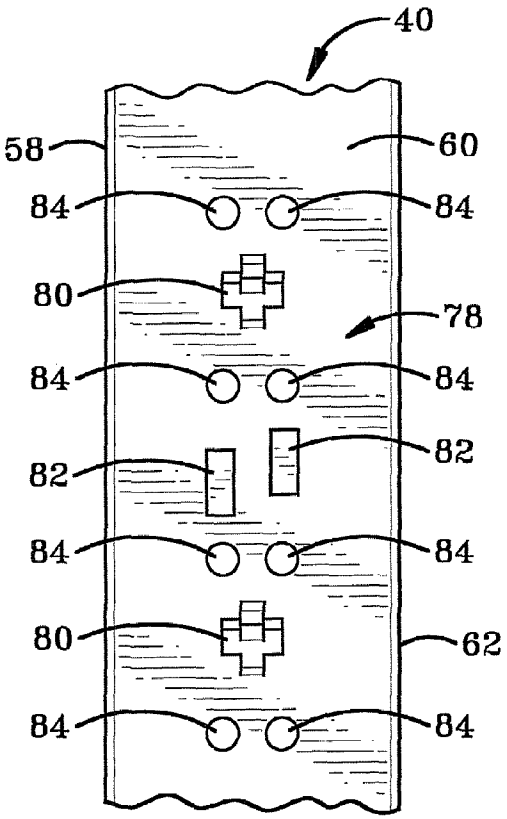
FIG. 8 is an enlarged side view of a preferred embodiment of the securing assembly of a hinge reinforcement portion of a base skin taken generally along line 8-8 in FIG. 2.
Figure 7:
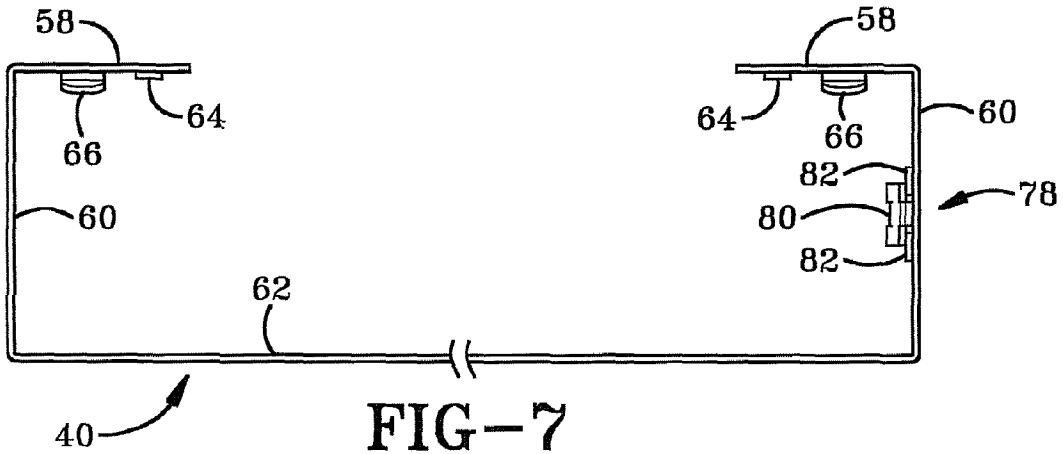
FIG. 7 is an endwise view of a preferred embodiment base skin with mounting slots.
Figure 12:
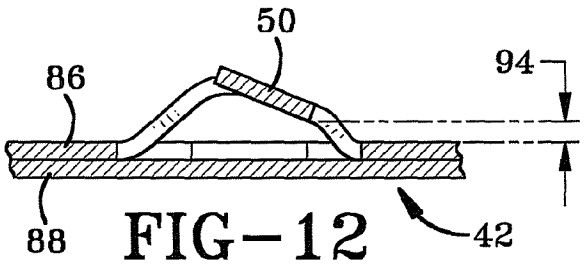
FIG. 12 is a sectional view of the preferred embodiment mounting protrusion taken generally along line 12-12 in FIG. 9.
Figure 11:
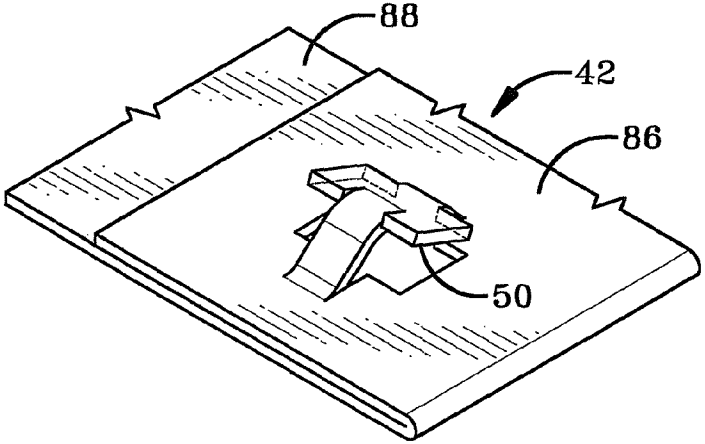
FIG. 11 is an enlarged perspective view of a preferred embodiment mounting protrusion.
Figure 9:
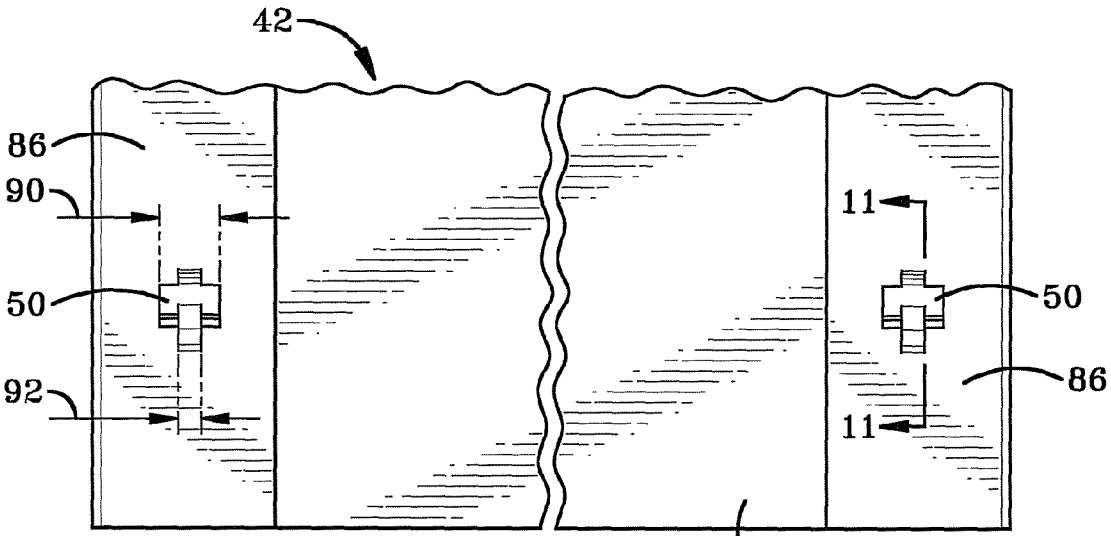
FIG. 9 is an enlarged front view of a preferred embodiment top skin with mounting protrusions.
Figure 10:
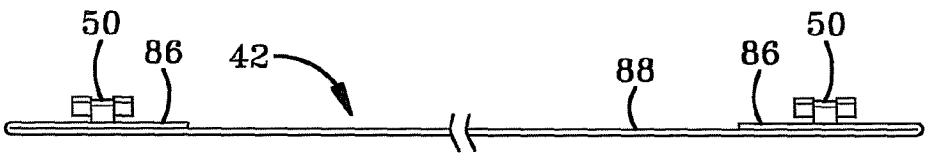
FIG. 10 is an endwise view of a preferred embodiment top skin with mounting protrusions.

In accordance with another the main features of the invention, FIGS. 6, 7, and 8 illustrate various views of base skin 40. The base skin includes first wall 58, side walls 60, and second wall 62. In a preferred embodiment, the first and second walls are generally parallel and spaced apart a distance approximately equal to the is length of the side walls. In addition, side walls 60 are generally perpendicular to both the first and second walls.

First wall 58 includes locking tab 64, locating tab 66, and mounting slots 48. Locking tab 64 has a first end 70 and second end 72. Preferably, first end 70 is generally parallel and located on the same plane as first wall 58. Second end 72 is preferably located above or below the plane of the first wall and is generally offset from first wall 58. Similar to locking tab 64, locating tab 66 includes a depressed end a flush end. However, the depressed and flush ends of locating tab 66 are generally the opposite of the locking tab ends and function only to limit the distance an object may be inserted within the base skin and to facilitate alignment of the inserted object. In a preferred embodiment, mounting slots 48 are generally located about the periphery of the base skin and include positioning portion 74 and locking portion 76 arranged to receive the protrusions of the top skin.

Referring to FIG. 8, hinge reinforcement area 78 incorporates axial protrusions 80, sliding locks 82, and mounting holes 84. Sliding locks 82, similar to locking tab 64, has a first end which is generally flush with side wall 60 and a second end opposite the first end which is depressed or raised from side wall 60. Preferably, sliding locks 82 are opposed to one another, meaning that the flush end of one sliding lock is adjacent to the raised end of another sliding lock. Finally, side wall 60 includes mounting holes 84 which are arranged to receive screws or bolts and secure hinges 34 as well as a hinge reinforcement plate (described infra). The hinge reinforcement area 78 has been described as a single area, but may be utilized along the side wall at any position where a hinge is located. The base skin may be composed of steel, stainless steel, aluminum, polycarbonate, or any other suitable plastic or metal composition.

Averting now to FIGS. 9, 10, 11, and 12, top skin 42 is shown with protrusions 50 axially extending from a top side. In a preferred embodiment, top skin 42 includes upper layer 86 parallel to, adjacent to, and generally situated atop lower layer 88. Upper layer 86 may be formed by folding an outer portion of lower layer 88 backwards and on top of lower layer 88. Advantageously, protrusions 50 extend axially from upper layer 86 so that lower layer 88 is a solid, flat wall and is aesthetically pleasing. While the present invention has been described with protrusions extending from an upper layer, it is within the spirit and scope of the present invention as claimed to incorporate protrusions extending directly from the lower layer, thereby rending the upper layer unnecessary.

Protrusions 50 must be designed and manufactured with certain specifications and tolerances to fit within the base skin mounting slots and still be releasably secured. Width 90 of the protrusions must be less than the width of positioning portion 74 but more than the width of locking portion 76. Width 92 of the protrusions must be less than both positioning portion 74 and locking portion 76. Advantageously, widths 90 and 92 allow the protrusions to be axially disposed within positioning portion 74 and then slid into locking portion 76. Further, height 94 of the protrusions must provide sufficient clearance to allow the base skin to fit between the protrusion and the top skin. Widths 90 and 92 and height 94 do not have to be any particular dimensions, but must be collectively scaled with the mounting slots to fit securely within the mounting slots. The top skin may be composed of steel, stainless steel, aluminum, polycarbonate, or any other suitable plastic or metal composition.

Figure 13:
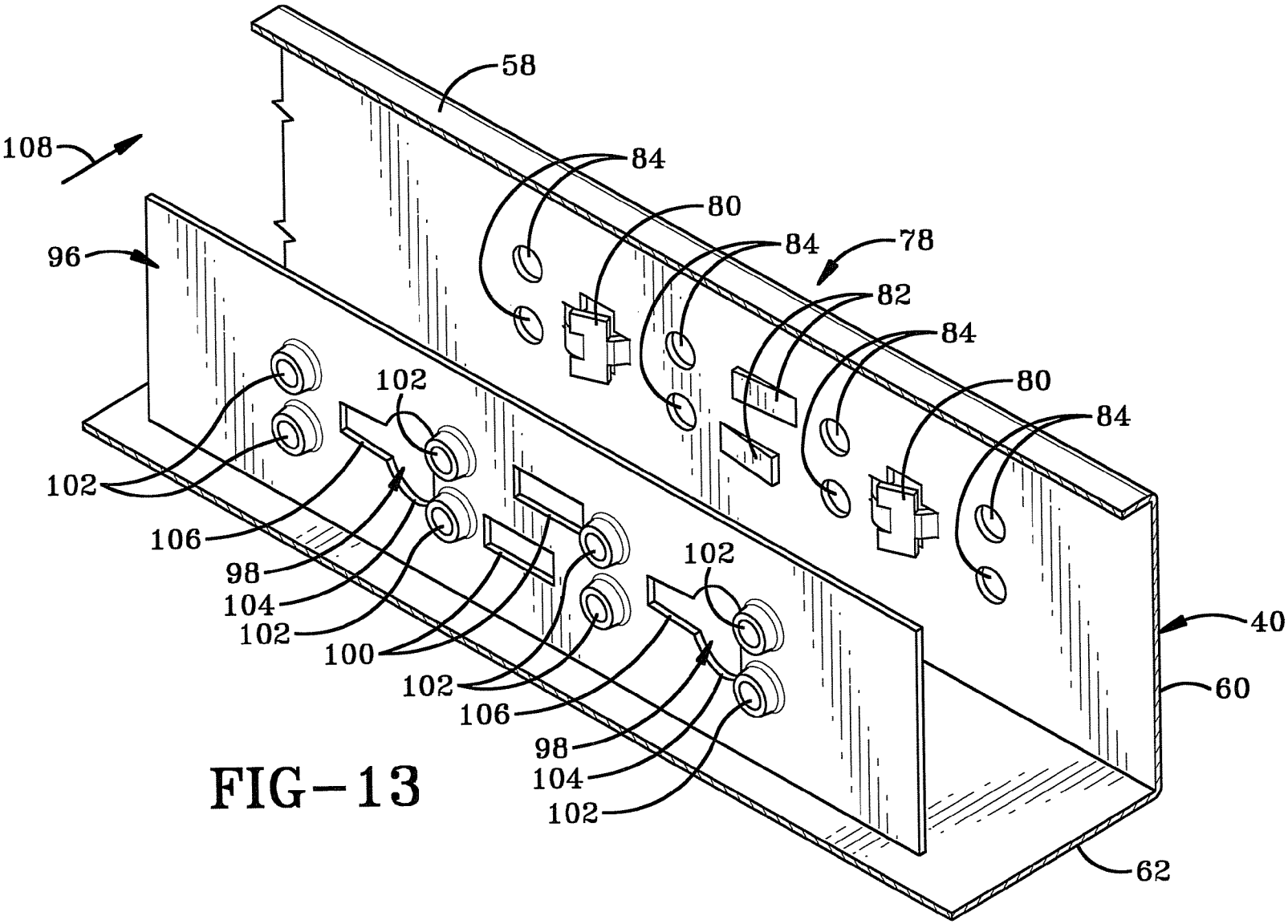
FIG. 13 is a perspective view of a preferred embodiment hinge reinforcement plate being located on a base skin.

Averting now to FIG. 13, hinge reinforcement plate 96 is illustrated with mounting slots 98, locking slots 100, and securing holes 102. Mounting slots 98 include positioning portion 104 and locking portion 106. Mounting slots 98 are arranged to function similar to the base skin mounting slots and thus the operation and interaction need not be repeated. Further, locking slots 100 are arranged to fit securely around sliding locks 82 to prevent movement of hinge reinforcement plate 96.

Figure 14:
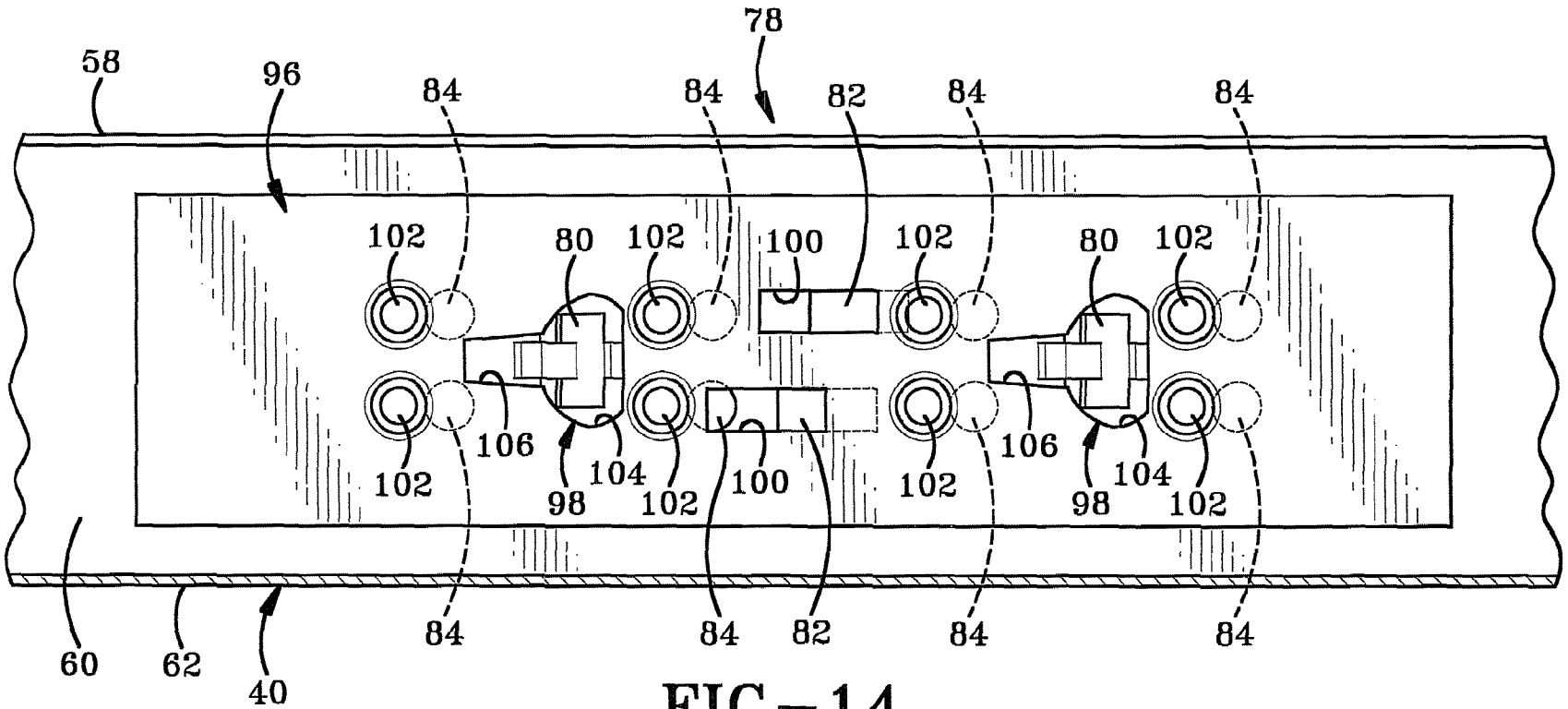
FIG. 14 is a front view of a preferred embodiment hinge reinforcement plate located on a base skin securing assembly.
Figure 15:
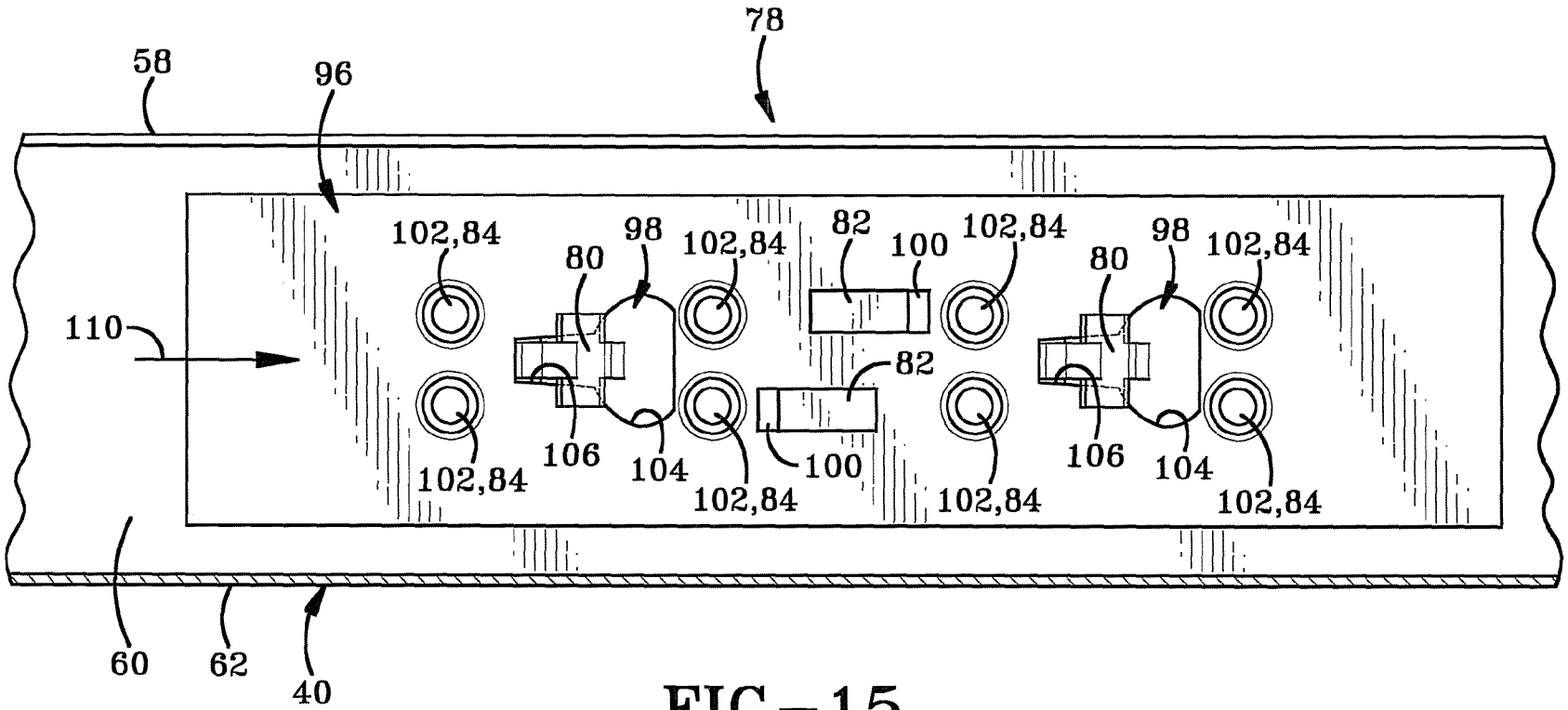
FIG. 15 is a front view of a preferred embodiment hinge reinforcement plate releasably secured to a base skin.

Having now described the structure of the interlocking door, a method of assembling the door will be described in detail. While the following is described as a series of steps, no particular order is to be inferred and is limited only by the appended claims. FIGS. 13, 14, and 15 illustrate hinge reinforcement plate 96 being installed on base skin 40 at side wall 60. Mounting slots 98 of the hinge reinforcement plate are axially disposed on the side wall axial protrusions in the direction indicated by arrow 108. In particular, positioning portion 104 of the mounting slots are axially disposed on axial protrusions 80 in the direction indicated by arrow 108. Next, hinge reinforcement plate 96 is slid in the direction indicated by arrow 110 so that protrusions 80 are located within locking portions 106, sliding locks 82 are secured within locking slots 100, and mounting holes 84 are aligned with securing holes 102.

Figure 16:
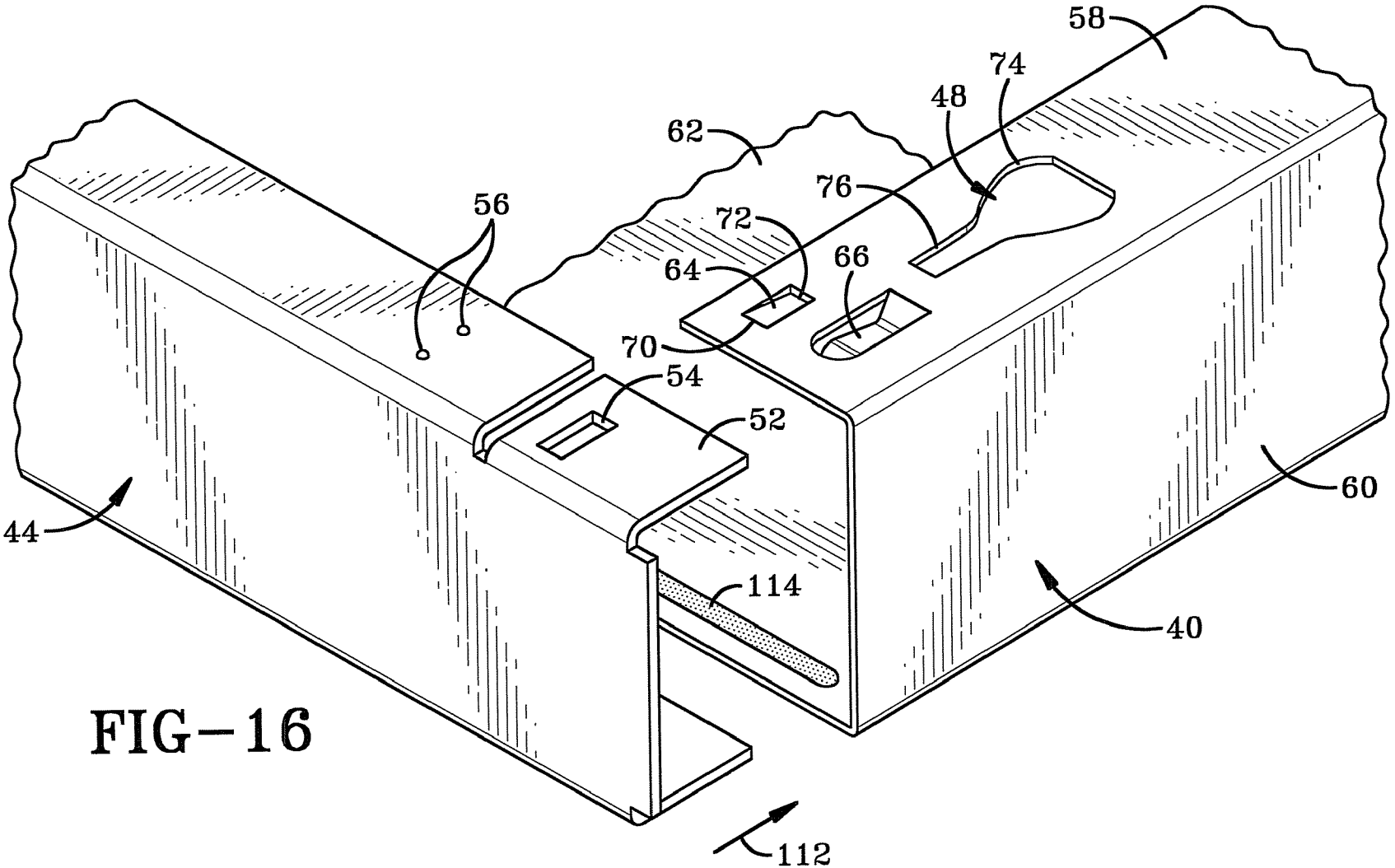
FIG. 16 is a perspective view of a corner of preferred embodiment end rail being secured to a base skin.
Figure 18:
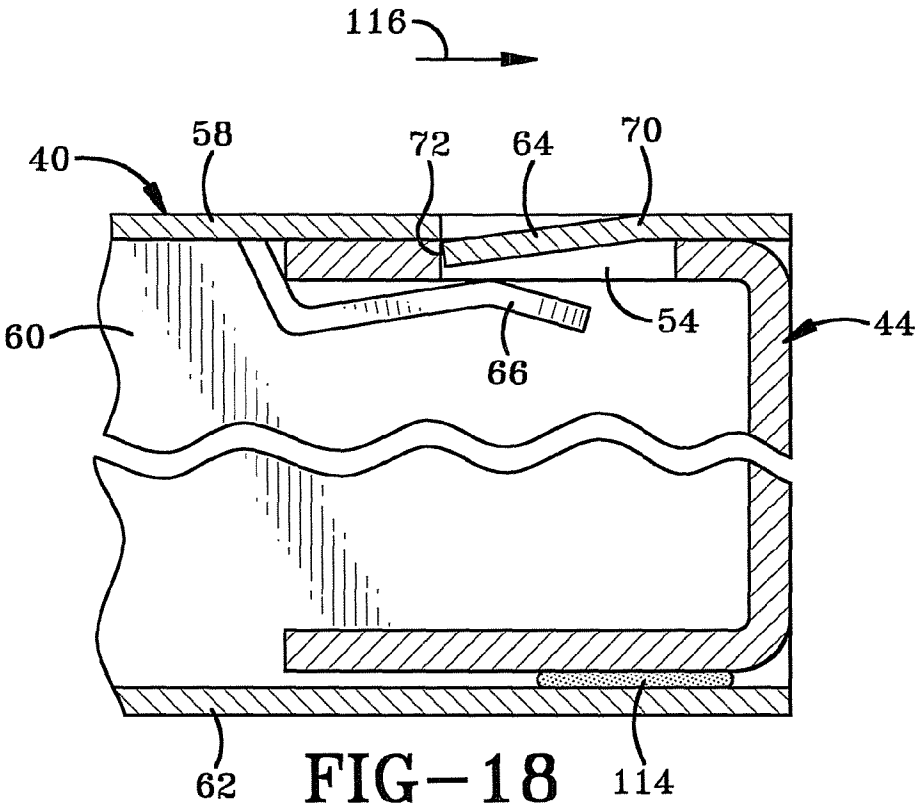
FIG. 18 is a sectional view of the secured end rail and base skin taken generally along line 18-18 in FIG. 17.
Figure 17:
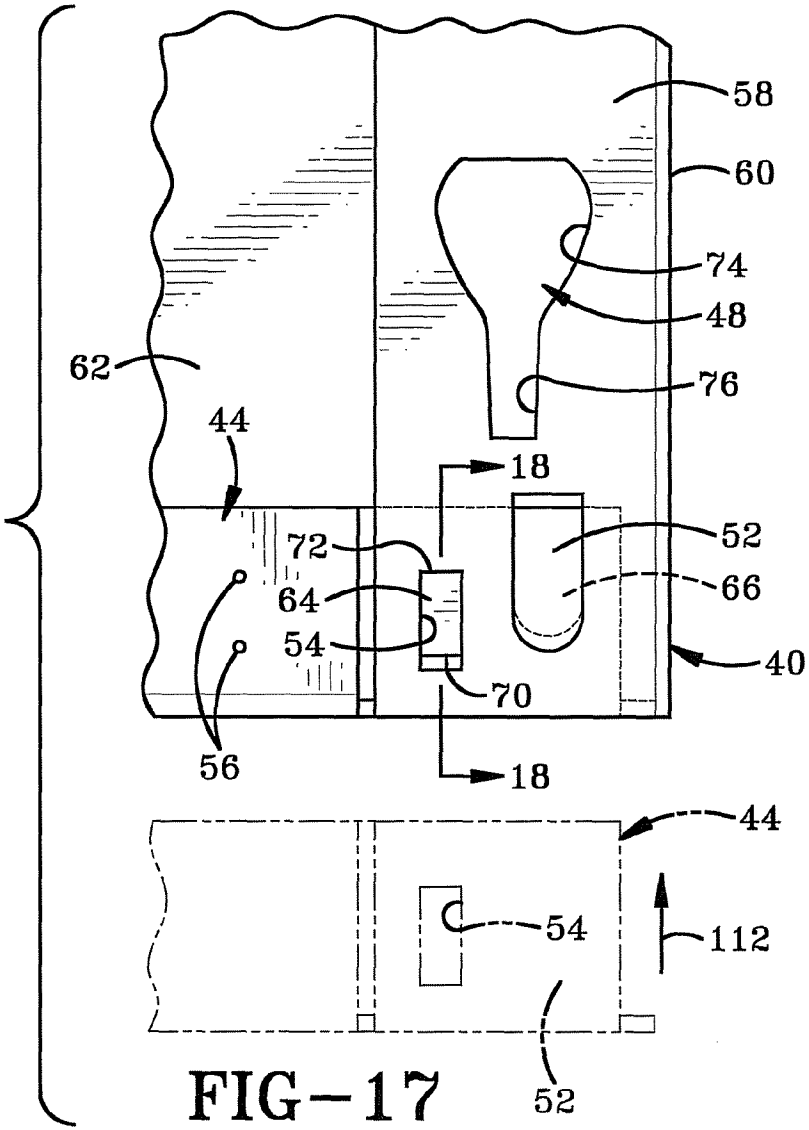
FIG. 17 is a top view of a preferred embodiment end rail secured to a base skin.

FIG. 16 shows lower end cap 44 being inserted within base skin 40 in the direction indicated by arrow 112. FIGS. 17 and 18 are views of the assembled corner of lower end cap 44 inserted within base skin 40. Prior to installation of lower end cap 44, adhesive 114 is applied to the inside of second wall 62. Fastening end 52 is then inserted within the base skin until the fastening end is secured between the bottom side of first wall 58 and locating tab 66. Further, the lower end cap and base skin are fixedly secured by engagement of slots 54 and locking tab 64, as well as fixedly secured by adhesive 114. As described supra, slot 54 is fixedly secured by second end 72 since the second end is disposed within slot 54 and prevents any movement of the lower end cap in the direction indicated by arrow 116. Thus, the lower end cap may readily be inserted within the base skin but may not be removed and is still fixedly secured within the base skin if the adhesive were to be dissolved or melted. The foregoing description of lower end cap 44 is applicable to upper end cap 46 which is both structurally and functionally similar and is inserted within the base skin in the same manner.

Figure 19:
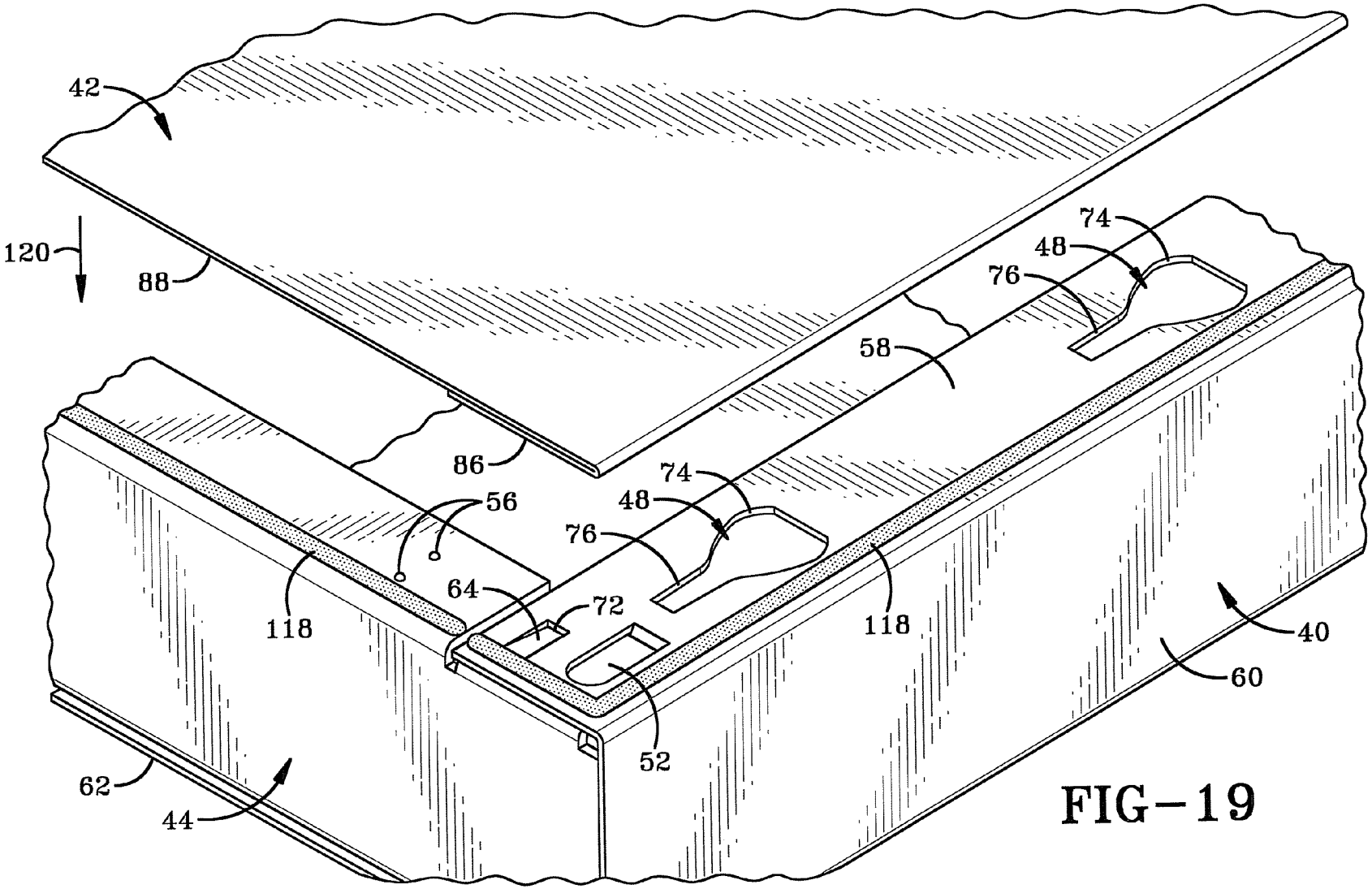
FIG. 19 is a perspective view of a corner of a preferred embodiment top skin being located on a combined base skin and end rail.
Figure 20:
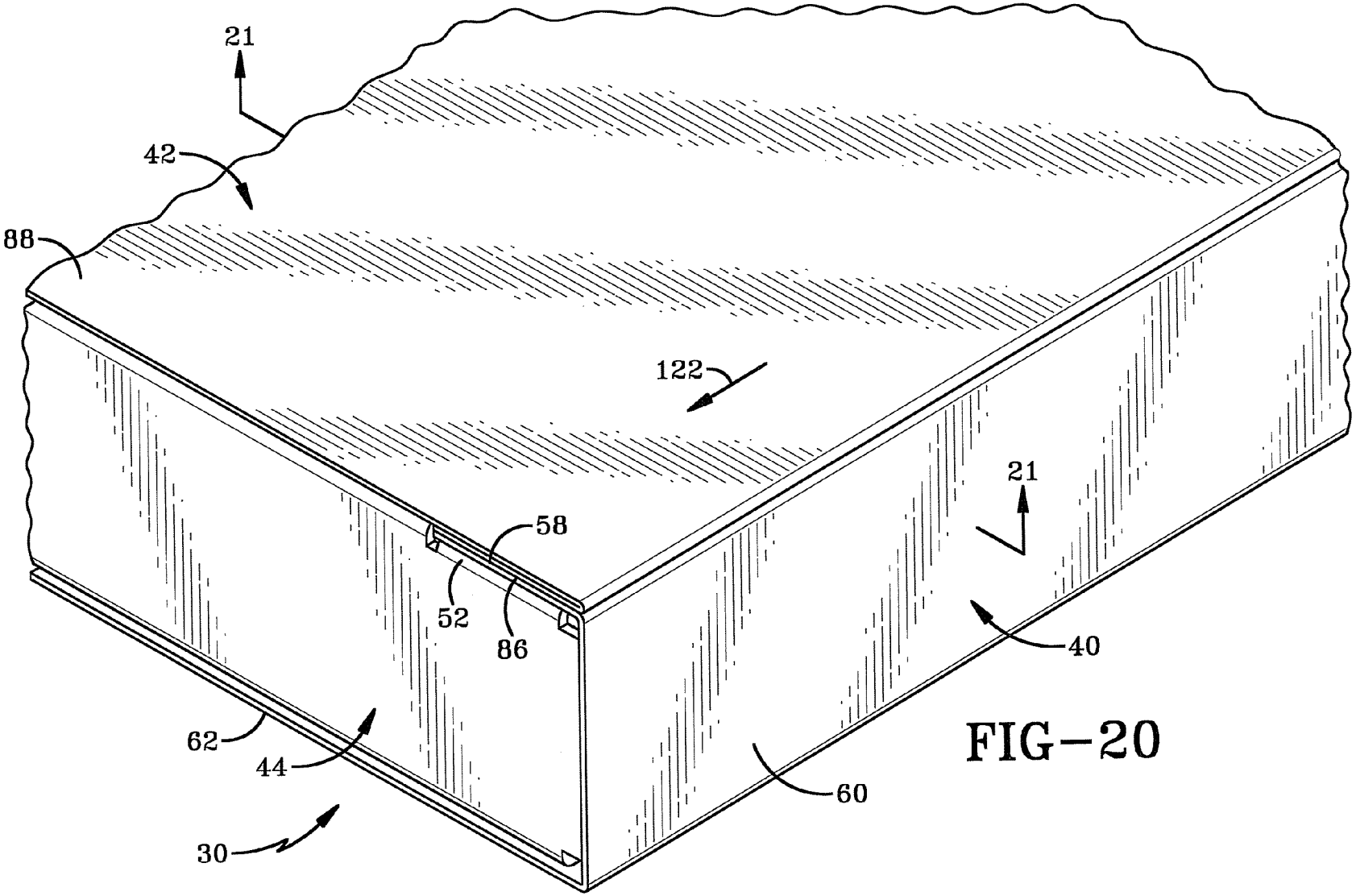
FIG. 20 is a perspective view of a corner of a preferred embodiment top skin secured to a combined base skin and end rail.

Averting now to FIGS. 19 and 20, where lower end cap 44 is shown inserted within base skin 40. Adhesive 118 is applied to the top of first wall 58 and lower end cap 44. Top skin 42 is then placed on top of adhesive 118 in the direction indicated by arrow 120 so that the protrusions of top skin 42 (not shown) are located within the positioning portion of mounting slots 48. The top skin is then slid in the direction indicated by arrow 122 to locate the top skin protrusions within the locking portion of the mounting slots. Advantageously, the top skin protrusions are secured within the locking portions by the downward force of gravity once the door assembly is mounted in a doorway. Alternatively, adhesive 118 may be applied to top skin 42 directly and then installed onto the top of first wall 58 and end caps 44.

Figure 21:
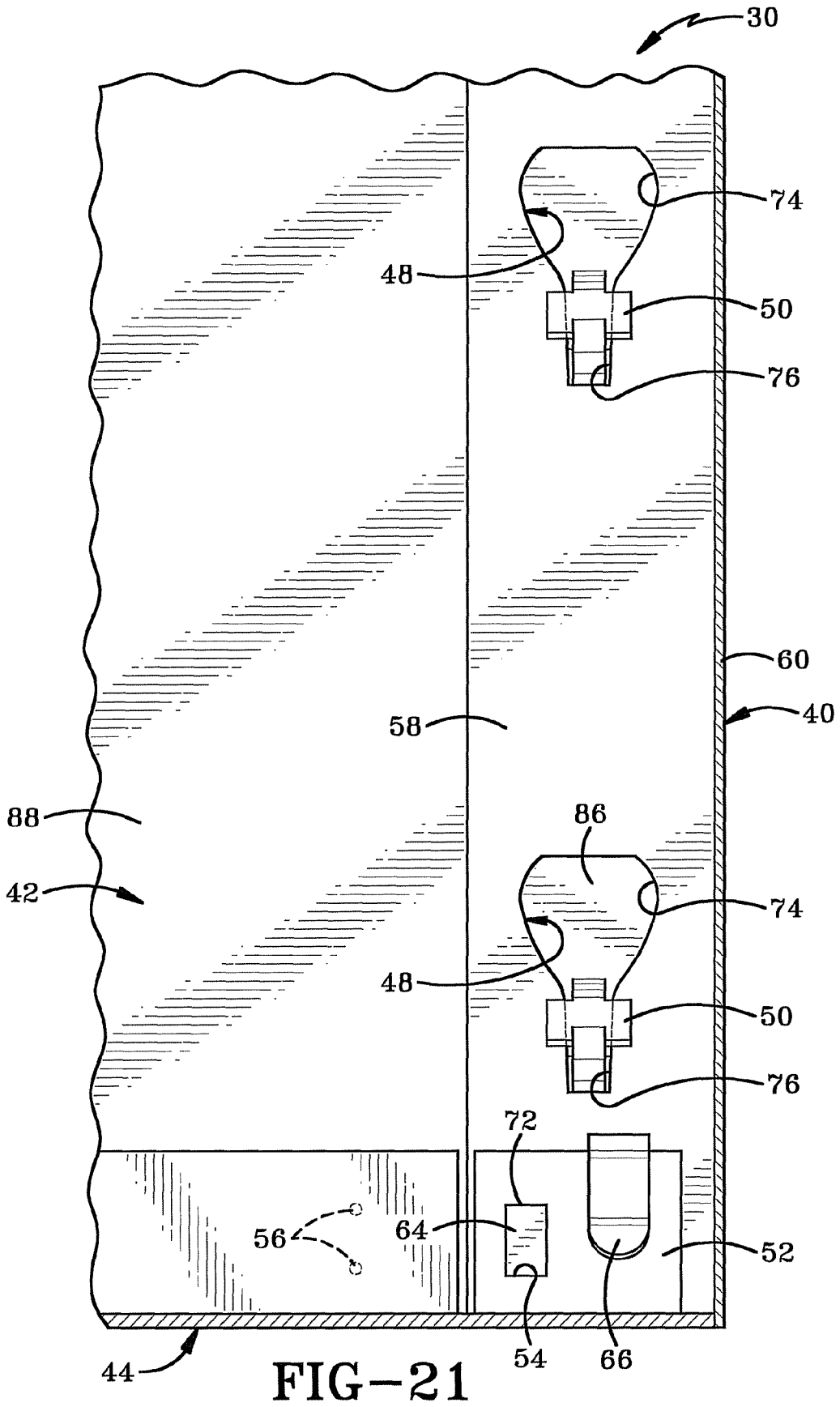
FIG. 21 is a sectional view of a preferred embodiment interlocking door assembly taken generally along line 21-21 in FIG. 20; and, FIG. 22 is an enlarged endwise view of one side of a preferred embodiment end rail secured to the bottom of an interlocking door assembly.
Figure 22:
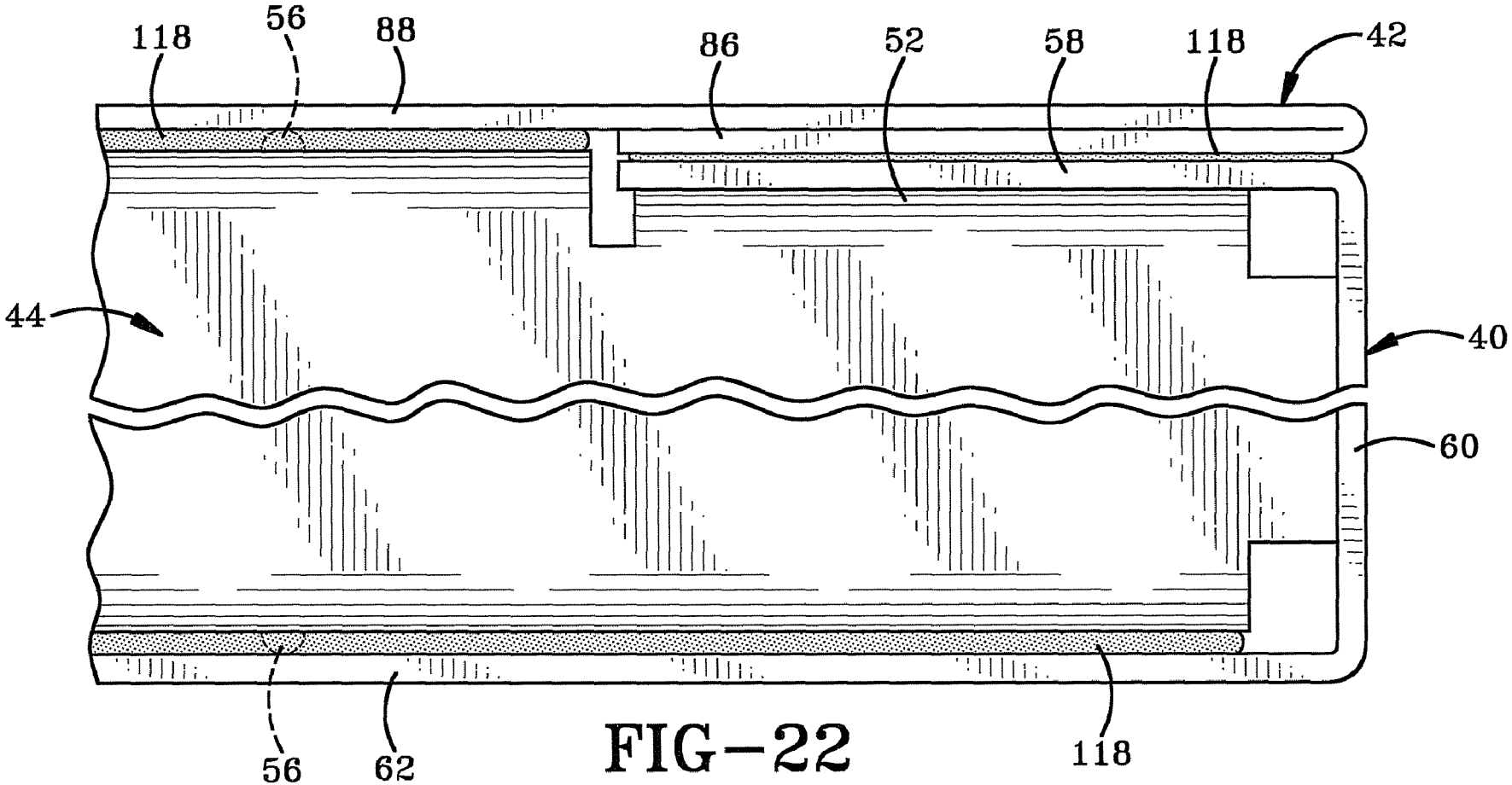

Further, FIG. 21 is a sectional view of a preferred embodiment door assembly with protrusions 50 secured within locking portion 76 of mounting slots 48. FIG. 22 is an enlarged endwise view of a preferred embodiment door assembly with adhesive 114 and adhesive 118 fixedly securing the skins and the end cap of the door assembly.

Having now described structure and a method of assembling the interlocking door, a method of manufacturing the door will be described in detail and should be viewed in light of FIGS. 1 though 22. Although the following is described as a series of steps, no particular order of steps is implied and as such is limited only by the appended claims.

Door assembly 30 is manufactured by stamping base skin 40 with locking tabs 64, mounting slots 48 having positioning portions 74 and locking portions 76, and side wall 60. Side wall 60 is then stamped with axial protrusions 80, sliding locks 82, and mounting holes 84. Hinge reinforcement plate 96 is then secured on axial protrusions 80 and sliding locks 82. Next, top skin 42 is stamped with protrusions 50 and end caps 44 and 46 are stamped with slots 54 and fastening ends 52. Adhesive 114 is then applied to an interior portion of base skin 40 and lower end cap 44 and upper end cap (not shown) are inserted within the base skin, respectively, and in contact with the adhesive. Adhesive 118 is then applied to a top side of lower end cap 44, upper end cap (not shown), and base skin 40 or to top skin 42. Next, protrusions 50 of the top skin are disposed within mounting slots 48 and top skin 42 is in contact with adhesive 118. Finally, the top skin and protrusions 50 are urged from positioning portion 74 to locking portion 76 in the direction indicated by arrow 122.

Accordingly, the interlocking door assembly is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the interlocking door is constructed and used, the characteristics of the construction, and the advantageous new and useful results obtained; the new and useful structures, devices, elements, arrangement, parts, combinations, and methods are set forth in the appended claims.

What is claimed is:

1. A metal door comprising:

a first skin;

a first mechanical connector integrally formed with the first skin;

a second mechanical connector integrally formed with the first skin whereby the first mechanical connector is different from the second mechanical connector;

a second skin having a third mechanical connector integrally formed therewith;

an end cap having a fourth mechanical connector, wherein said end cap is fixedly secured to said first skin upon operative engagement of said first mechanical connector and said fourth mechanical connector; and wherein said second skin is secured to said first skin upon engagement of said second mechanical connector and said third mechanical connector.

2. The door of claim 1 wherein the engagement of the first mechanical connector and the fourth mechanical connector prevents removal of the end cap.

3. The door of claim 1 wherein the first skin further comprises a stop preventing movement of the end cap beyond said stop.

4. The door of claim 1 wherein the first mechanical connector includes at least one of a locking tab and a mounting slot, the second mechanical connector includes at least one of a mounting slot and a protrusion, the third mechanical connector includes at least one of a mounting slot and a protrusion, and the fourth mechanical connector includes at least one of a locking tab and a mounting slot.

5. The door as defined in claim 1 in which the end cap is fixedly secured to said first skin upon a sliding engagement between the first mechanical connector and the fourth mechanical connector.

6. The door of claim 1 wherein the second mechanical connector comprises a mounting slot having a positioning portion and a locking portion.

7. The door of claim 6 wherein the third mechanical connector comprises a protrusion and wherein the second skin is releasably secured to the first skin upon sliding engagement of the protrusion from the positioning portion to the locking portion.

8. The door of claim 1 wherein the end cap further comprises a plurality of bosses.

9. The door of claim 1 wherein the second mechanical connector comprises a plurality of mounting slots disposed about a periphery of the first skin.

10. The door of claim 1 wherein the end cap is fixedly secured to the first skin with an adhesive and the second skin is fixedly secured to the first skin with an adhesive.

11. The door of claim 3 wherein the end cap is releasably secured within the stop.

12. The door of claim 1 wherein the first skin further comprises a first wall and a second wall generally parallel to and adapted to be spaced away from the first wall by a side wall.

13. The door of claim 12 wherein the side wall further comprises at least one axial protrusion, a plurality of sliding locks, and at least one mounting hole.

14. The door of claim 13 further comprising at least one hinge reinforcement plate having at least one mounting slot, a plurality of locking slots, and at least one securing hole.

15. The door of claim 14 wherein the at least one hinge reinforcement plate is fixedly secured to the side wall upon sliding engagement of the at least one axial protrusion and the at least one mounting slot.

16. The door of claim 14 wherein the at least one hinge reinforcement plate is fixedly secured to the side wall upon sliding engagement of the plurality of sliding locks and the plurality of locking slots.

17. A metal door comprising:

a first skin;

a first mechanical connector formed with the first skin;

a second mechanical connector formed with the first skin whereby the first mechanical connector is different from the second mechanical connector;

a second skin having a third mechanical connector formed with the second skin;

at least one hinge plate having at least one hinge plate mechanical connector formed with the hinge plate, wherein the at least one hinge plate is secured to the first skin upon engagement of the first mechanical connector and the at least one hinge plate mechanical connector;

wherein the second skin is secured to the first skin upon engagement of the second mechanical connector and the third mechanical connector; and wherein the at least one hinge plate mechanical connector comprises at least one mounting slot and a plurality of locking slots and the first mechanical connector comprises at least one axial protrusion and a plurality of sliding locks.

18. The metal door of claim 17, wherein the at least one hinge plate mechanical connector further comprises at least one securing hole and the first mechanical connector further comprises at least one at least one mounting hole.

19. The metal door of claim 18 wherein the at least one hinge plate is fixedly secured to the first skin upon sliding engagement of at least one of the at least one axial protrusion and the at least one mounting slot and the plurality of sliding locks and the plurality of locking slots.

20. A metal door comprising:

a first skin;

a first, second and third mechanical connector formed with the first skin, wherein the first, second and third mechanical connectors are different from one another;

a second skin having a fourth mechanical connector formed with the second skin;

an end cap having a fifth mechanical connector, wherein said end cap is fixedly secured to said first skin upon operative engagement of said first mechanical connector and said fifth mechanical connector;

at least one hinge plate having at least one hinge plate mechanical connector formed with the hinge plate, wherein the at least one hinge plate is secured to the first skin upon engagement of the third mechanical connector and the at least one hinge plate mechanical connector; and wherein the second skin is secured to the first skin upon engagement of the second mechanical connector and the fourth mechanical connector.

* * * * *